US012458149B2

(12) United States Patent
Lin

(10) Patent No.: US 12,458,149 B2
(45) Date of Patent: Nov. 4, 2025

(54) AIR CONDITIONING AIR-PERMEABLE MATTRESS

(71) Applicant: Po-Heng Lin, Taichung (TW)

(72) Inventor: Po-Heng Lin, Taichung (TW)

( * ) Notice: Subject to any disclaimer, the term of this patent is extended or adjusted under 35 U.S.C. 154(b) by 136 days.

(21) Appl. No.: 18/503,209

(22) Filed: Nov. 7, 2023

(65) Prior Publication Data

US 2024/0065447 A1 Feb. 29, 2024

Related U.S. Application Data

(63) Continuation of application No. PCT/US2022/072357, filed on May 16, 2022.

(30) Foreign Application Priority Data

May 17, 2021 (TW) ..... 110205622

(51) Int. Cl.
*A47C 21/04* (2006.01)
*A47C 27/00* (2006.01)
*A47C 27/05* (2006.01)

(52) U.S. Cl.
CPC ..... *A47C 21/04* (2013.01); *A47C 27/007* (2013.01); *A47C 27/056* (2013.01)

(58) Field of Classification Search
CPC ..... A47C 21/04; A47C 27/007; A47C 27/056; A47C 21/044; A47C 27/064; A47C 27/146; A47C 27/15; A47C 27/144
See application file for complete search history.

(56) References Cited

U.S. PATENT DOCUMENTS 5,416,935 A * 5/1995 Nieh ..... A47C 21/044 297/180.13
7,877,827 B2 * 2/2011 Marquette ..... F25B 21/02 5/652.2
9,211,017 B2 * 12/2015 Tyree ..... A47C 27/148
9,955,791 B2 * 5/2018 Chandler ..... A47C 27/18
(Continued)

FOREIGN PATENT DOCUMENTS

CN 103932856 B 5/2016
KR 20050101152 A 10/2005
TW M550587 U 10/2017

OTHER PUBLICATIONS

International Search Report of PCT Patent Application No. PCT/US2022/072357 issued on Jul. 29, 2022.

*Primary Examiner* — Fredrick C Conley

(57) ABSTRACT

An air conditioning air-permeable mattress includes a mattress body and a ventilation module. The mattress body forms a cavity housing a support member. The top face of the mattress body includes air outputting bores and connected with the cavity. All lateral sides of the mattress body excluding the top face include at least one air outlet connected with the cavity. The ventilation module is disposed outside the mattress body and connected with the air outlet through pipeline, whereby the air flow is discharged through the air outputting bores, and the running noise of machine would not affect sleeping quality. The inside of the mattress body is connected with the outside only through the air outlet and the air outputting bores, whereby the air supply of the ventilation module maintains the air flow in the mattress body for lowering the temperature of the mattress body surface.

11 Claims, 5 Drawing Sheets

(56) References Cited

U.S. PATENT DOCUMENTS

| | | | | |
|---|---|---|---|---|
| 10,194,752 | B2 | 2/2019 | Zaiss et al. | |
| 2010/0011502 | A1* | 1/2010 | Brykalski | A47C 21/04 5/423 |
| 2012/0080911 | A1* | 4/2012 | Brykalski | B60N 2/5657 297/180.15 |
| 2015/0289667 | A1* | 10/2015 | Oakhill | A47C 27/18 5/423 |
| 2018/0242753 | A1* | 8/2018 | Ghanei | A47C 21/044 |
| 2020/0000241 | A1* | 1/2020 | Jansen | A47C 17/04 |

* cited by examiner

AIR CONDITIONING AIR-PERMEABLE MATTRESS

CROSS REFERENCE TO RELATED APPLICATIONS

The present application is a Continuation application of PCT Application No. PCT/US2022/072357 filed on May 16, 2022, which claims the benefit of Taiwanese Patent Application No. 110205622 filed on May 17, 2021. All the above are hereby incorporated by reference in their entirety.

BACKGROUND OF THE INVENTION

1. Field of the Invention

The present invention relates to an air conditioning air-permeable mattress, which provides ventilation toward the upward direction of the mattress for improving the muggy sensation after long period of sleeping.

2. Description of the Related Art

Human spends one third of life sleeping. A good mattress is known to facilitate a good sleeping quality. When choosing a mattress, consumers mainly consider various factors such as whether the mattress provides an expected support, proper degree of softness and hardness, ventilation, muggy sensation preventing capability after long sleep, and price.

Referring to TW patent M550587, a multifunctional bed frame structure and a multifunctional bed set using it are disclosed, whose basic structure allows the airflow generated by a fan module to flow upward to the mattress, so as to improve the sultry sensation and possible bacterial growth issue caused after a long-term placement of the mattress on the bed board or long-term bed resting. Such bed frame structure contains the fan module in an inner fan module of the bed frame, and is unable to prevent noise generated during operation which results in sleep disturbance. Also, the air intake volume of the fan module is unable to be finely tuned. Further, in such bed frame structure, it is necessary to include multiple fan modules evenly distributed on the upper plate of the bed frame structure, or the air flow is prevented from being evenly distributed to the mattress above it.

SUMMARY OF THE INVENTION

For achieving the aforementioned objectives, the present invention provides an air conditioning air-permeable mattress, comprising a mattress body and a ventilation module. The mattress body forms an internal cavity which houses a support member. The top face of the mattress body comprises a plurality of air outputting bores evenly distributed thereon and connected with the cavity. All lateral sides of the mattress body excluding the top face comprise at least one air outlet connected with the cavity, respectively. The ventilation module is disposed outside the mattress body, and connected with the air outlet through the pipeline, such that the air flow is discharged through the plurality of air outputting bores.

The cavity in the mattress body is basically connected with the outside through the air outlet and air outputting bore, so that the air supply provided by the ventilation module is mostly sent toward the air outlet. The cavity inside the mattress is configured to evenly distribute the air supply in the overall cavity. With the air outputting distributed on the upper surface of the mattress body, the ventilation is maintained to provide a proper temperature for comfortable sleeping. Also, the ventilation module is disposed outside the mattress body, so as to prevent the running noise of machine from affecting sleeping quality of user.

Further, the support member is applied for supporting the bodyweight of the user. The support member can be a pad body having a plurality of air ducts, allowing the air flow to be efficiently distributed in the cavity. The plurality of air ducts are connected with a plurality of air outputting bores.

Further, the pad body comprises an upper pad and a lower pad, both of which have a plurality of convex blocks disposed at intervals on one lateral side thereof, wherein those lateral sides of the upper pad and the lower pad are combined, whereby a plurality of air ducts are created inside the pad body formed by the upper pad and the lower pad.

Further, the air ducts are distributed in a cross or cellular arrangement, so that the pad body provides a proper support strength.

Further, the support member is allowed to be a connection type spring pad or a plurality of pocket springs, which does not affect the airflow distribution in the cavity.

Further, the inner lateral side of the mattress body forming the cavity comprising at least one air guiding groove, by which the air supply of the ventilation module efficiently flows along the surface of the inner lateral side, and subsequently flows inward to the central portion of the cavity.

Further, the mattress body comprises a side wall between the top face and the bottom face. An air inlet is disposed on the outer lateral side of the side wall and connected with the pipeline of the ventilation module, wherein the side wall comprises a plurality of air outlets connected with the air inlet and distributed on the inner lateral side of the side wall. Such structure corresponds to the pipeline distribution of the ventilation module, whereby the air supply is dispersed to the side walls of different areas.

Further, the top face of the mattress body is covered with a surface fabric layer for adjusting the air pressure of the top face. The surface fabric layer has a pore density which is able to adjust the flow rate of the air flow passing through the air outputting bores, so as to provide a comfortable sleeping quality.

Further, the top face of the mattress is a sponge mat which is favorable to even distribution of the air flow above the mattress body.

Further, the mattress body comprises a plurality of cavities. There are different air supply conditions for the ventilation module to provide air supply to the cavities. The air supply conditions include at least one of the temperature, flow rate, or filtration degree of the air supply.

Further, the support member comprises a pressure sensing module. The pressure sensing module and the ventilation module are electrically connected to the control module, and the control module controls the ventilation module according to the air supply conditions.

DETAILED DESCRIPTION OF THE INVENTION

In the following description, the surface of the mattress body applied for supporting the user is defined as the upper surface of the present invention in accordance with the common understanding of people having ordinary skills in the field.

Figure 6:
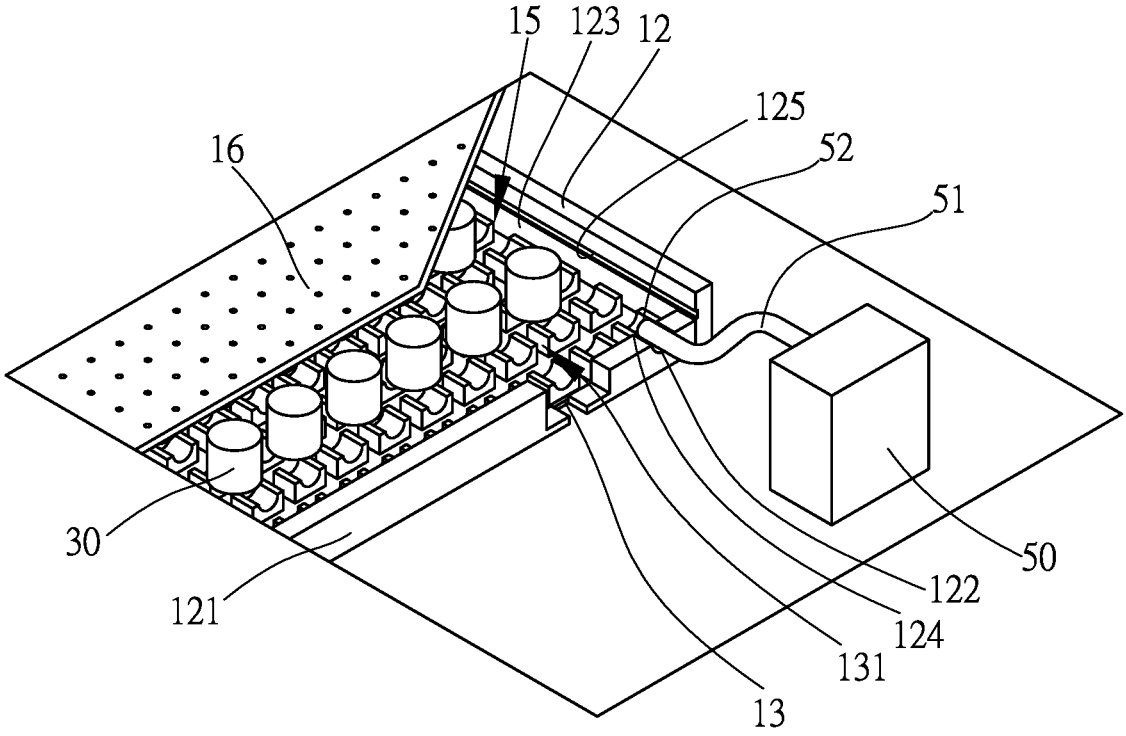
FIG. 6 is a schematic view of the air conditioning air-permeable mattress in accordance with the third embodiment of the present invention.

Referring to FIG. 1 to FIG. 4, the structure of an air conditioning air-permeable mattress is illustrated, comprising a mattress body 10 and a ventilation module 50 (as shown by FIG. 6.). The ventilation module 50 is located outside the mattress body 10. The ventilation module 50 comprises a pipeline 51 connected with a cavity 15 inside the mattress body 10.

The mattress body 10 comprises a top face 11 and a bottom face 13 formed in a plate shape, and a circularly-shaped side wall 12 between the top face 11 and the bottom face 13, wherein the top face 11, the side wall 12, and the bottom face form an internal cavity 15. The top face 11 comprises a plurality of air outputting bores 111 distributed thereon and connected with the cavity 15. The outer lateral side 121 of the side wall 12 comprises an air inlet 122, and an inner lateral side 123 of the side wall 12 comprises an air outlet 124 connected with the cavity 15.

Figure 8:
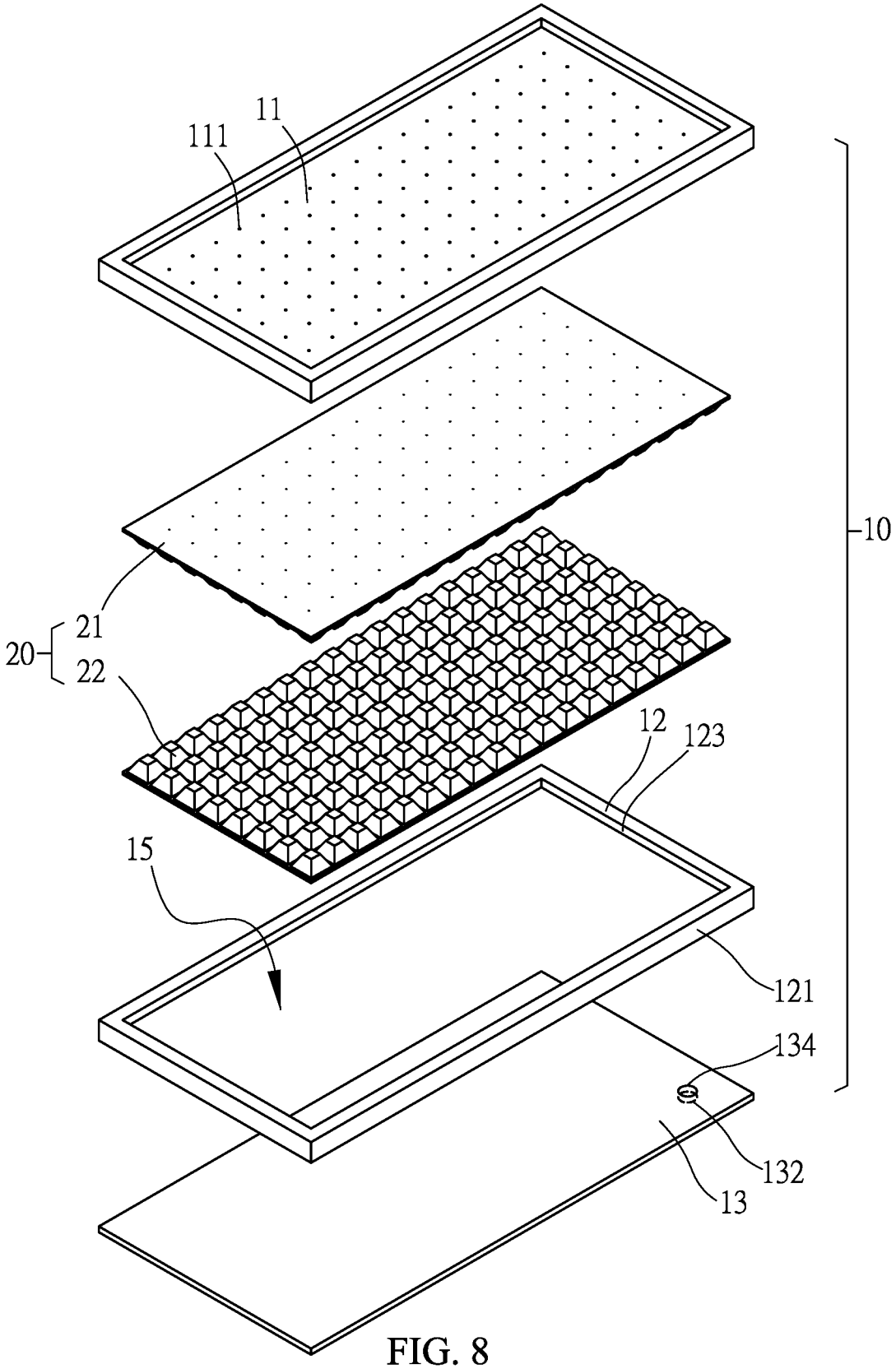
FIG. 8 is a schematic view of the air conditioning air-permeable mattress in accordance with the fourth embodiment of the present invention.

In this embodiment, the air inlet 122 and the air outlet 124 of the mattress body 10 are respectively an inner opening and an outer opening of a through hole passing through the side wall 12. The pipeline 51 of the ventilation module 50 passes through the air inlet 122 and the air outlet 124, so that an air inputting opening 52 of the pipeline 51 is connected into the cavity 15. Notably, referring to the embodiment of FIG. 8, the air inlet 132 and the air outlet 134 are allowed to be opened on two lateral sides of the bottom face 13, wherein the air inlet 132 and the air outlet 134 form a through hole passing through the bottom face 13, whereby the pipeline 51 of the ventilation module 50 passes therethrough for providing the air supply.

Further referring to FIG. 1 to FIG. 4, the cavity 15 inside the mattress body 10 is connected to the outside only through the air outlet 124 and the air outputting bore 111, so that the air supply provided by the ventilation module 50 flows almost only toward the air outlet 124. The cavity 15 inside the mattress body 10 is designed to evenly distribute the air supply to the overall cavity 15, and then the air supply passes through the air outputting bore 111 to be distributed to the upper face of the mattress body 10, thereby maintaining the ventilation, lowering temperature, and providing a temperature for comfortable sleeping. In addition, the ventilation module 50 is disposed outside the mattress body 10, so as to prevent the running noise of machine from affecting sleeping quality of the user, and also facilitate the convenience of subsequent maintenance and filter screen replacement operation.

Notably, a photocatalyst module or filter screen (such as HEPA filter screen) may be disposed between the pipeline 51 of the ventilation module 50 to purify or filter the air supply, maintain the quality of the air discharged from the air outputting bores 111, and disinfect or sterilize the inside of the mattress body 10. Also, a temperature adjusting module may be disposed in the pipeline 51 of the ventilation module 50 for adjusting the temperature of the air delivered into the cavity 15 by the ventilation module 50. Therein, the ventilation module 50 and the temperature adjusting module are electrically connected with a control module. Therefore, an air supply condition is able to be set for adjusting the internal temperature inside the mattress body 10, whereby the user lying on the mattress body 10 feels a proper temperature, so as to improve the living quality and increase the sleeping quality. Also, usage of the present invention is healthier and more environmentally friendly.

Also, the top face 11 of the mattress body 10 is covered with a surface fabric layer 60 for adjusting the air pressure of the top face 11. The surface fabric layer 60 is allowed to be a knitted fabric, woven fabric, or air-permeable film. When the air pressure of the top face 11 reaches a predetermined value, the air in the cavity 15 permeates through the surface fabric layer 60 to the outer side of the mattress. Regarding the air pressure adjustment method of the surface fabric layer 60, for example, the pore density is configured to be able to adjust the flow rate of the air after passing through the air outputting bores 111. For another example, the fabric density of a specific area of the surface fabric layer 60 of the top face 11 is configured to be able to adjust the flow rate of the air passing through the air outputting bore 111. For still another example, the surface fabric layer 60 covering the top face 11 is partially air-permeable and partially air-impermeable.

In detail, all six surfaces of the outer lateral side of the mattress body 10 are covered by the surface fabric layer 60. The fabric density of the fabric covering the top face 11 is lower than the fabric density of the fabric covering other surfaces (side wall 12 and bottom face 13). Alternatively, the fabric covering the side wall 12 and the bottom face 13 is formed of air-impermeable material, such as plastic fabric or an emulsion attached fabric, such that the air flow of the cavity 15 of the mattress body 10 is only allowed to flow toward the top face 11, whereby the air flow is concentrated on the user, achieving the aforementioned effects and providing a comfortable sleeping quality.

The support member inside the mattress body 10 is a foam-formed pad body 20 for supporting the bodyweight of the user. The pad body 20 comprises an upper pad 21 and a lower pad 22 that are formed in a plate shape, such that the pad body 20 is disposed on the bottom face 13 and supports the pressure imposed on the top face 11 of the mattress body 10. The flat plate face of the upper pad 21 comprises through bores 211 passing therethrough. The lateral sides of the upper pad 21 and the lower pad 22 contacting each other comprise a plurality of upper convex blocks 215 and lower convex blocks 225 disposed at intervals, respectively. When those lateral sides of the upper pad 21 and the lower pad 22 are combined, the top faces of the upper convex blocks 215 and the lower convex blocks 225 are also combined to form a plurality of air ducts 25 inside the pad body 20.

Figure 1:
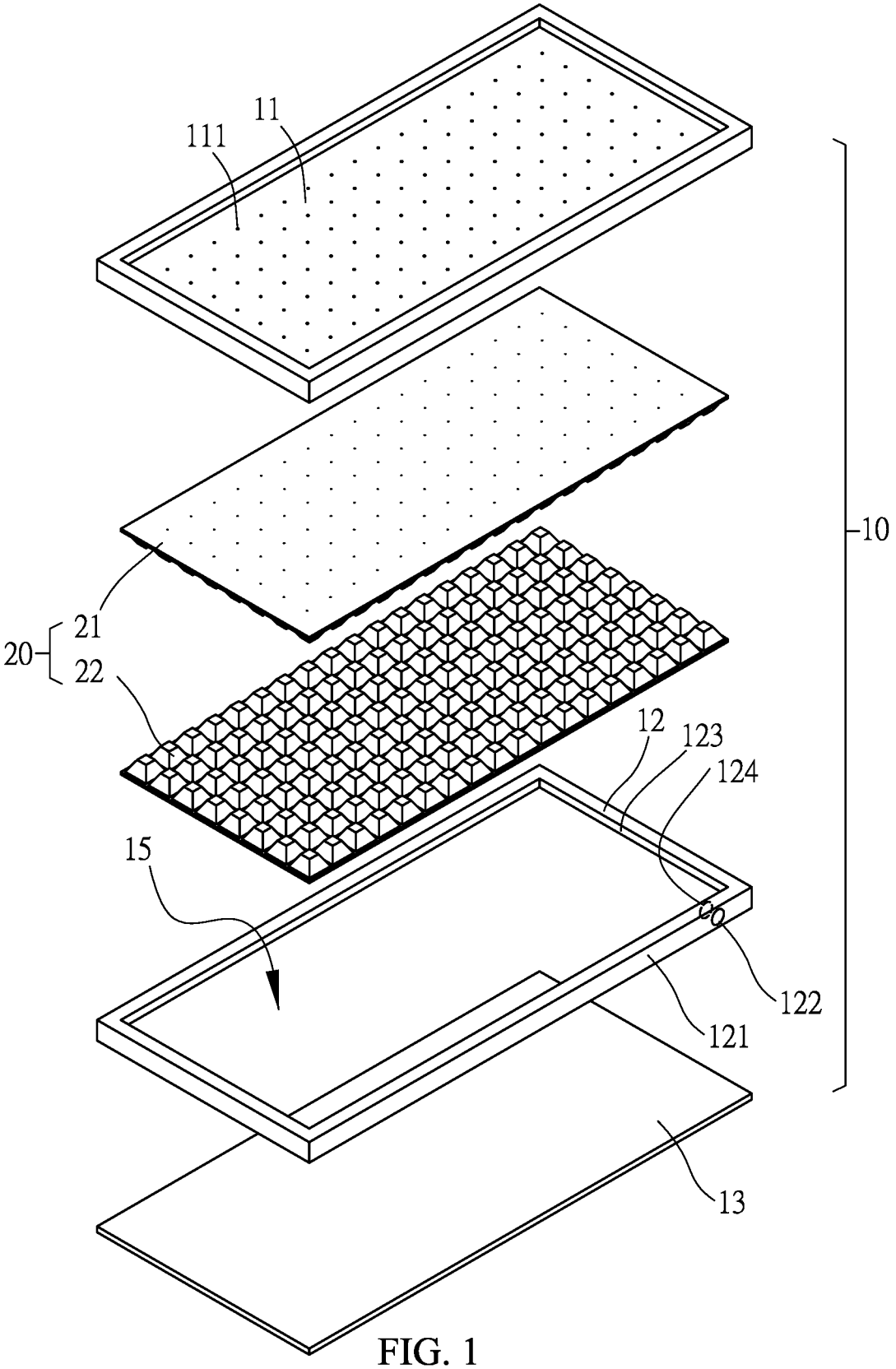
FIG. 1 is a schematic view of the mattress body of the air conditioning air-permeable mattress in accordance with the first embodiment of the present invention.
Figure 2:
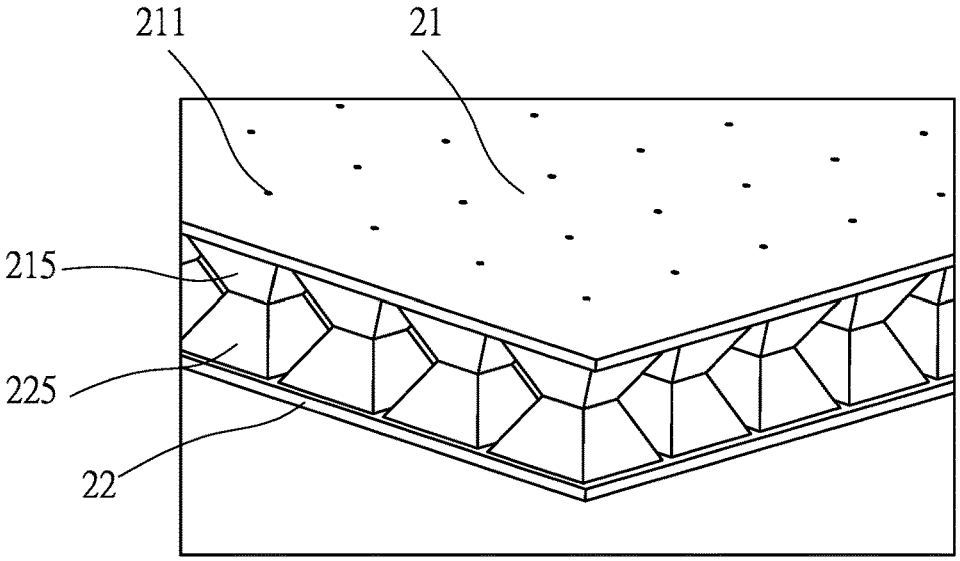
FIG. 2 is an enlarged view of the pad body of FIG. 1.
Figure 3:
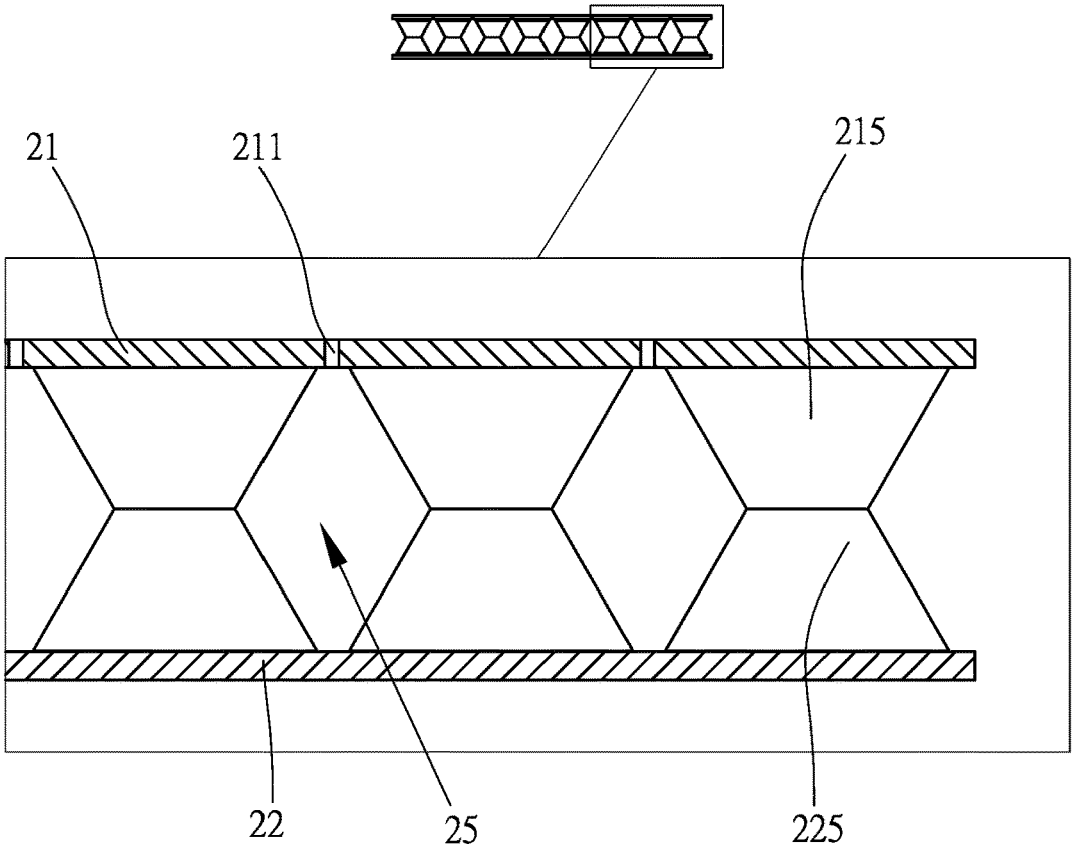
FIG. 3 is a sectional view of the pad body of FIG. 1.
Figure 4:
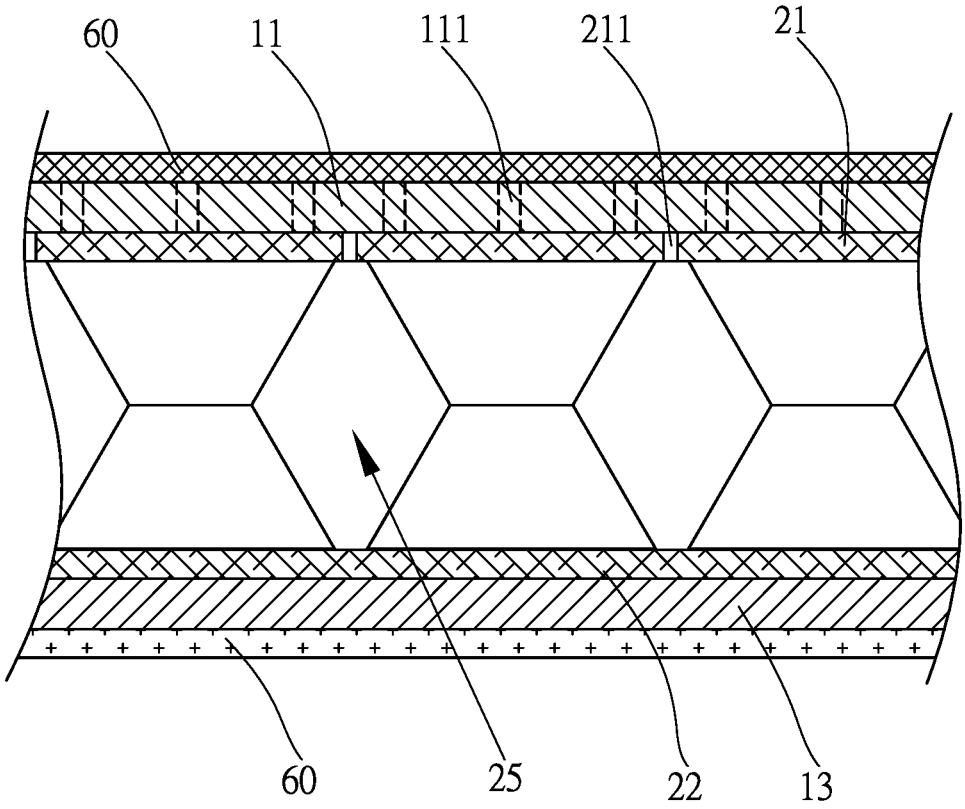
FIG. 4 is a schematic view of the mattress body in accordance with the second embodiment of the present invention.
Figure 5:
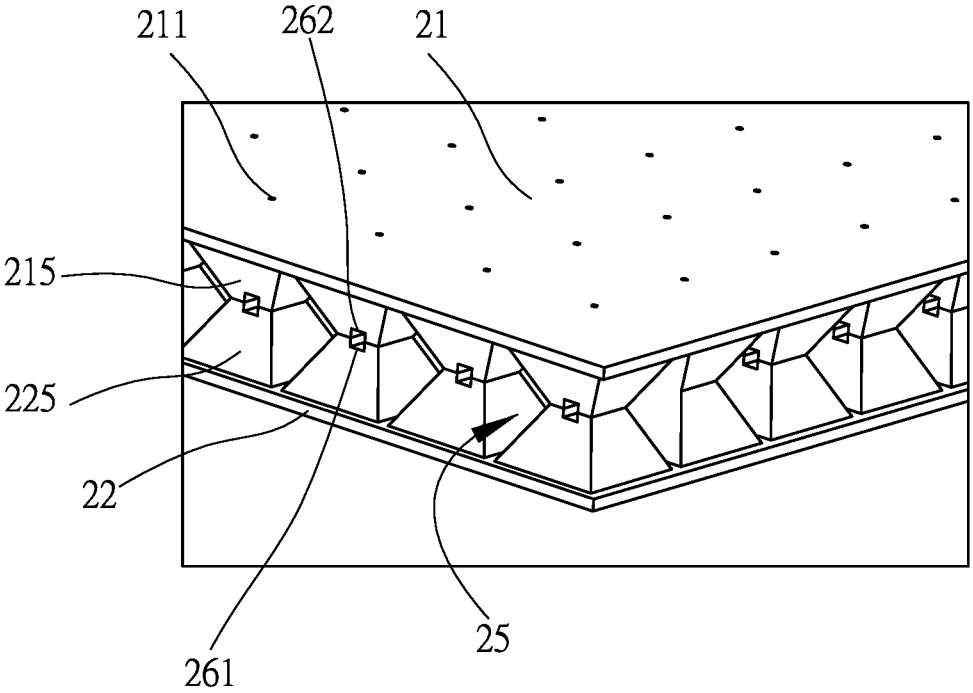
FIG. 5 is a schematic view of the pad body in accordance with another embodiment of the present invention.

Referring to the embodiment in FIG. 5, the top faces of the convex blocks 215 and the convex blocks 225 that are contacting each other comprises a recess 261 and recess 262, respectively, so that the recess 261 and recess 262 are combined to form the air duct 25 between the convex block 215 and the convex block 225.

The air duct between the upper pad 21 and the lower pad 22 allows the air supply of the ventilation module 50 to be efficiently distributed in the cavity 15, so as to pass the through bores 211 of the upper pad 21 to be discharged from the air outputting bores 111 of the top face 11. Notably, the air ducts 25 inside the pad body 20 are distributed in a cross arrangement. Alternatively, the air ducts 25 are allowed to be designed into a cellular arrangement, thereby providing sufficient support strength or adjusting the air flow rate inside the cavity 15.

Figure 7:
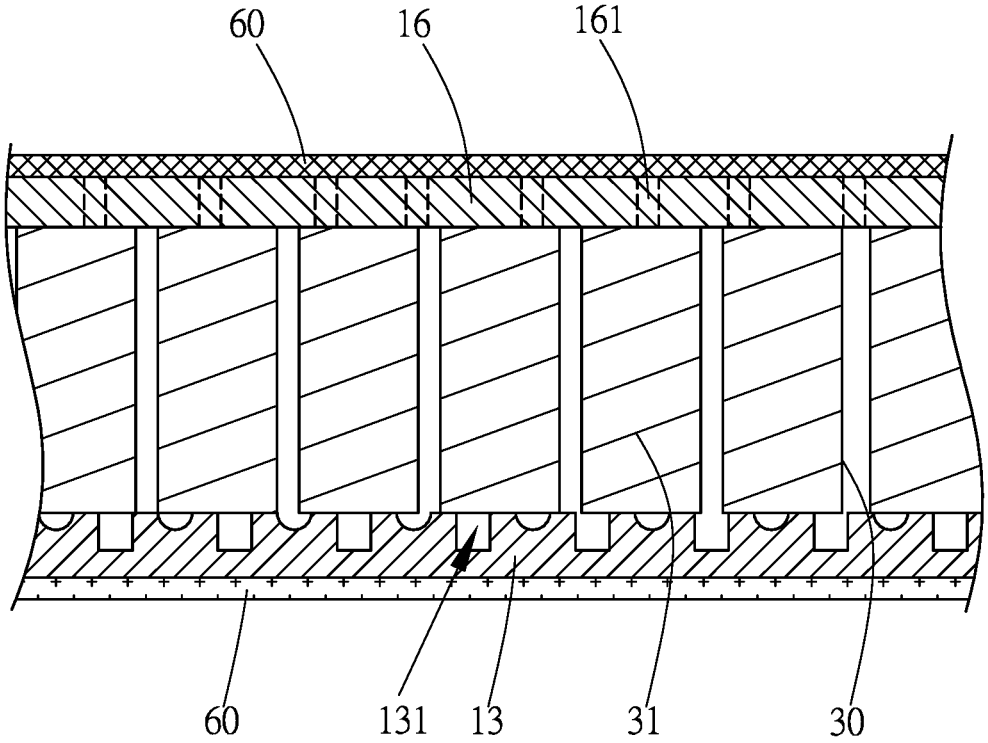
FIG. 7 is a sectional view of FIG. 6.

Referring to FIG. 6 to FIG. 7, another embodiment of the air conditioning air-permeable mattress is illustrated. The support member inside the cavity 15 is a plurality of pocket springs 30 disposed in an array arrangement, so that the air flow distribution in the cavity 15 is not affected. Further, the cloth sleeve on the outer side of each pocket spring 30 may comprises through holes or be formed of an air-permeable non-woven fabric. Therefore, the purifying air provided by the ventilation module 50 is able to disinfect or sterilize the inside or the spring 31 of each pocket spring 30.

If the pocket springs 30 of different rows are disposed in a staggered arrangement, or if the middle part of the pocket spring 30 is wider than other parts thereof, when the mattress body 10 is imposed with pressure to deform, the air flow upward in the middle area of the cavity 15 may be affected. Therefore, the top face of the mattress body 10 (not shown) and/or the inner lateral side of the bottom face 13 is able to be provided with an air guiding groove 131, such that the air supply of the ventilation module 50 enters the middle area of the bottom face 13 of the cavity 15 and then flows upward, allowing the internal air to efficiently flow.

In this embodiment, the inner lateral side 123 of the side wall 12 of the mattress body 10 comprises an air guiding groove 125, so that the air supply of the ventilation module 50 efficiently flows along the surface of the air guiding groove 125 and flows around the outermost side of the support member, and is finally delivered to the middle part of the cavity 15. For achieving the effect, the air outlet 124 of the side wall 12 may be disposed in adjacent to the air guiding groove 125, such that a part of air directly flows into the air guiding groove 125, accelerating the internal circulation of the air supply in the cavity 15.

In this embodiment, the outermost side of the whole support member may have a predetermined distance with respect to the inner lateral side 123 of the side wall 12, such that the distance gap becomes a primary air duct during air intake of the ventilation module 50. Therefore, the air supply flows along the inner lateral side 123 of the side wall and flows around the outermost side of the support member. Meanwhile, the air duct inside the support member becomes a secondary air duct.

According to the types of the support member (such as a foam-formed pad, pocket spring, or connection type spring pad) in the cavity 15, the air guiding groove 125 may be selectively disposed on the top face 11 or the bottom face 13. The air guiding groove 125 may be arranged in a cross shape distribution to facilitate the fast air flow, or in a cellular distribution for creating disturbance or dispelling of air flow near the top face 11 or the bottom face 13, thus facilitating the even distribution of air flow.

In this embodiment, the top face 11 of the mattress body 10 is formed of a material of sponge mat 16, so that the air flow finally permeating from the surface fabric layer 60 is allowed to be evenly distributed without the need of a perforation process on the pad body of the top face 11 to produce air outputting bores 111.

In different embodiments, the air outlet 124 on the inner lateral side 123 of the side wall 12 is provided in a plural amount and distributed to different positions of the inner lateral side 123. Therefore, the air supply of the ventilation module 50 is able to be dispersed to the side walls 12 of different areas and enter different positions of the cavity 15. The plurality of air outlets 124 are connected with the air inlet 122 on the outer lateral side 121 of the side wall 12 through respective pipelines. Or, the side wall 12 comprises a hollow cavity inside connected with the plurality of air outlets 124 for producing a proper air supply distribution.

In various embodiments, a single-layer foam comprising air ducts may be disposed inside the cavity 15. Such arrangement does not affect the air flow in the cavity 15.

The air outputting bores 111 and the air outlet 124 of the mattress body 10 should be designed to be located away from each other as far as possible, so that the air supply of the ventilation module 50 is allowed to be distributed in the cavity 15 first after passing through the air outlet 124, and then discharged from the air outputting bore 111 on the top face 11 of the mattress body 10. In different embodiments, on the premise of achieving the aforementioned technical effects, the bottom face 13 may also be provided with an air outlet 124 connected with the cavity 15.

In other embodiments, a partition may be disposed in the middle part of the mattress body 10, so that the cavity 15 is divided into two independent cavities connected with a respective ventilation module 50. The aforementioned ventilation module 50 is able to be set with specific air supply conditions. For example, at least one of the conditions of the air supply temperature, air supply flow rate, and the air supply filtration degree in the respective cavities is allowed to be correspondingly adjusted according to actual requirements, thereby meeting the needs of the user. The partition of the cavity 15 is able to be, for example but not limited to, a foam pad or partitioning cloth.

In other embodiments, a pressure sensing module may be disposed on the support member of the mattress body 10. The pressure sensing module, temperature adjusting module, and ventilation module are electrically connected with a control module. The pressure sensing module is applied for sensing the pressure generated by the bodyweight of user, and then sends the pressure value to the control module. Meanwhile, the pressure value is also set as the air supply condition of the ventilation module 50 here in this embodiment. When the pressure sensing module senses or the control module determines that the user leaves the support member, the control module controls the ventilation module to stop supplying air or change flow rate of the air supply, or stop the temperature adjusting module from adjusting the temperature of the air supply.

What is claimed is:

1. An air conditioning air-permeable mattress, comprising:

a mattress body forming a cavity therein, the cavity housing a support member, a top face of the mattress comprising a plurality of air outputting bores connected with the cavity, all lateral sides of the mattress body excluding the top face being provided with at least an air outlet connected with the cavity; and a ventilation module disposed outside the mattress body and connected with the at least an air outlet through a pipeline, so as to provide an air supply which is discharged from the air outputting bores, wherein the air supply of the ventilation module passes through a temperature adjusting module first and then enters the cavity;

wherein the support member is a pad body having a plurality of air ducts formed therein, and the air ducts are connected with the air outputting bores;

wherein, the pad body comprises an upper pad and a lower pad, a side of the upper pad is facing to a side of the lower pad, both of the side of the upper pad and the side of the lower pad are provided with a plurality of convex blocks arranged at intervals, each of the plurality of convex blocks is a cone-shaped block, and a top surface of the cone-shaped block protruding from the side of the lower pad is supporting to a top surface of the cone-shaped block protruding from the side of the upper pad, the remaining surfaces of the cone-shaped block are formed the air ducts within the pad body.

2. The air conditioning air-permeable mattress of claim 1, wherein the mattress body comprises a plurality of cavities.

3. The air conditioning air-permeable mattress of claim 2, wherein the ventilation module comprises different conditions of the air supply, include at least one of temperature, flow rate, and filtration degree of the air supply.

4. The air conditioning air-permeable mattress of claim 1, wherein the air ducts are distributed in a cross arrangement.

5. The air conditioning air-permeable mattress of claim 1, wherein the support member comprises a pressure sensing module; the pressure sensing module and the ventilation module are electrically connected to a control module, and the control module controls the ventilation module according to a condition of the air supply.

6. The air conditioning air-permeable mattress of claim 1, wherein an inner lateral side of the mattress body forming the cavity comprise at least an air guiding groove.

7. The air conditioning air-permeable mattress of claim 6, wherein the at least an air guiding groove is distributed in a cross or cellular arrangement.

8. The air conditioning air-permeable mattress of claim 1, wherein the mattress body comprises a side wall between the top face and the bottom face; an air inlet is disposed on an outer lateral side of the side wall and connected with the pipeline of the ventilation module; the side wall comprises a plurality of air outlets connected with the air inlet and distributed on an inner lateral side of the side wall.

9. The air conditioning air-permeable mattress of claim 1, wherein the top face of the mattress body is covered with a surface fabric layer for adjusting an air pressure of the top face.

10. The air conditioning air-permeable mattress of claim 9, wherein all lateral sides of the mattress body excluding the top face are covered with an air-impermeable surface fabric layer.

11. The air conditioning air-permeable mattress of claim 1, wherein the top face of the mattress is a sponge mat.

* * * * *